US005688142A

United States Patent [19]

Dietz et al.

[11] Patent Number: 5,688,142

[45] Date of Patent: Nov. 18, 1997

[54] ELETRICAL CONNECTOR POSITION ASSURANCE SYSTEM

[75] Inventors: Holger Dietz, Karlsbad; Alexander Popa, Leutenbach, both of Germany

[73] Assignee: Molex Incorporated, Lisle, Ill.

[21] Appl. No.: 541,849

[22] Filed: Oct. 10, 1995

[30] Foreign Application Priority Data

Oct. 10, 1994 [EP] European Pat. Off. ..... 94115922

[51] Int. Cl.[6] ..... H01R 13/71

[52] U.S. Cl. ..... 439/487; 439/352

[58] Field of Search ..... 439/488, 489, 439/350, 352, 357, 358, 345, 354

[56] References Cited

U.S. PATENT DOCUMENTS

| | | | |
|---|---|---|---|
| 4,634,204 | 1/1987 | Petter et al. | 439/352 |
| 4,711,511 | 12/1987 | Noorily | 439/347 |
| 4,950,179 | 8/1990 | Takenouchi et al. | 439/352 |
| 4,993,967 | 2/1991 | Matsumoto | 439/489 |
| 5,074,803 | 12/1991 | Chandler et al. | 439/347 |
| 5,112,243 | 5/1992 | Chow et al. | 439/352 |
| 5,120,255 | 6/1992 | Kouda et al. | 439/489 |
| 5,163,848 | 11/1992 | Maeda et al. | 439/489 |
| 5,192,225 | 3/1993 | Suzuki | 439/352 |
| 5,292,258 | 3/1994 | Sakurai | 439/352 |

FOREIGN PATENT DOCUMENTS 0449239 3/1991 European Pat. Off. ..... H01R 13/639

*Primary Examiner*—Hien Vu

*Attorney, Agent, or Firm*—A. A. Tirva

[57] ABSTRACT

A connector position assurance system is provided for an electrical connector adapted to mate with another mateable connecting device. The connector includes a housing, and a primary locking arm is mounted on the housing for movement between a first position when the connector is fully mated with the mateable connecting device and second position of incomplete mating of the connector with the device. The primary locking arm includes a latch for mechanically interlocking with a cooperating latch of the mateable connecting device. A locking slider is mounted in a recessed area of the housing so as to be shrouded by the housing. The slider is slidable between a first position allowing movement of the locking arm and mating of the connector and the device, and a second position blocking movement of the locking arm from its first position with the connector and the device fully mated. The locking arm, in its second position, blocks movement of the locking slider from its first position to its second position and thereby indicates that the connector and the device are not fully mated.

6 Claims, 3 Drawing Sheets

ELETRICAL CONNECTOR POSITION ASSURANCE SYSTEM

FIELD OF THE INVENTION

This invention generally relates to the art of electrical connectors and, particularly, to a connector position assurance system for an electrical connector adapted to mate with another mateable connecting device.

BACKGROUND OF THE INVENTION

Electrical connectors normally require secure mechanical and electrical engagement between one electrical connector and a mateable electrical connector or other mateable connecting device. Various latching systems have been used with electrical connectors to provide such secure engagement. Such systems usually provide this secure engagement with ease of attachment and detachment. For instance, latching mechanisms have been developed which include pivotally supported latching arms that interlock with each other or that interlock with a complementary latching mechanism of the mateable connector or connecting device.

In addition, connector position assurance devices also are known in the art. Typically, the primary function of such devices is to verify that the connectors are fully mated and latched, i.e. that the latching mechanisms are fully or securely engaged. A secondary function often is to prevent the latching mechanisms from inadvertently unlatching and permitting the connectors to separate. These connector position assurance functions may be accomplished in a variety of ways, but most prior art connector position assurance systems employ a spacer that cannot be inserted into its intended position unless the latching arm is fully engaged, and the latching arm cannot be moved when the spacer is properly positioned. However, problems often are encountered with such removable spacers because they may be lost or misplaced. In addition, the various mechanisms are not shrouded by the connector, i.e. all kinds of protrusions are created on which electrical wires can become snagged. The present invention is directed to solving these problems and satisfying a need for an improved connector position assurance system.

SUMMARY OF THE INVENTION

An object, therefore, of the invention is to provide a new and improved connector position assurance system for an electrical connector adapted to mate with another mateable connecting device.

In the exemplary embodiment of the invention, an electrical connector includes a housing, and a primary locking arm is mounted on the housing for movement between a first position when the connector is fully mated with the mateable connecting device and a second position of incomplete mating of the connector with the device. The primary locking arm includes a latch for mechanically interlocking with a cooperating latch of the mateable connecting device.

The invention contemplates the provision of a locking slider mounted in a recessed area of the housing so that the slider is shrouded by the housing. The locking slider is slidable between a first position allowing movement of the locking arm and mating of the connector and the mateable connecting device, and a second position blocking movement of the locking arm away from its second position with the connector and the device fully mated. The locking arm, in its second position of incomplete mating of the connector with the device, blocks movement of the locking slider from its first position to its second position and thereby indicates that the connector and the device are not fully mated.

As disclosed in the preferred embodiment, the housing is fabricated of molded plastic material, and the primary locking arm is pivoted to the housing by an integral living hinge means. The pivotally mounted locking arm has a distal end, including its latch, that is pivotal in an arcuate path into and out of the path of sliding movement of the locking slider.

Still further, the recessed area of the housing is provided by a channel on the exterior of the housing in which the locking slider is mounted and shrouded by the housing. Detent means are provided between the housing and the locking slider for maintaining the slider in its first position. The locking slider includes a serrated surface exposed exteriorly of the housing to facilitate manual gripping of the slider by a user's finger.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
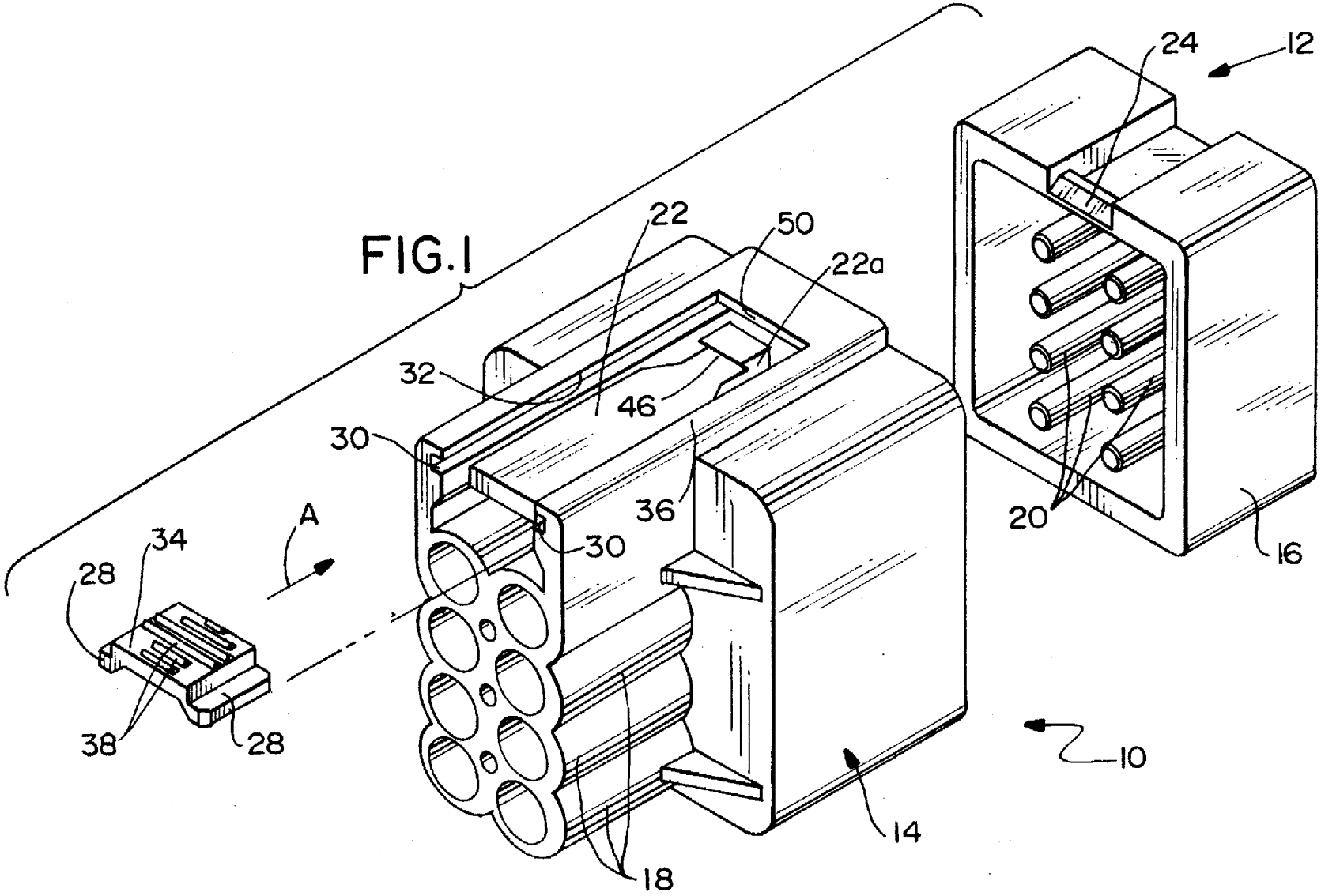
FIG. 1 is an exploded perspective view of an electrical connector along with the locking slider therefor, in conjunction with a mateable connecting device.

Referring to the drawings in greater detail, and first to FIG. 1, the connector position assurance system of the invention is incorporated in an electrical connector, generally designated 10, which is adapted to mate with another connector or mateable connecting device, generally designated 12. Connector 10 includes a unitarily molded dielectric housing, generally designated 14, of plastic or like material. Connector 12 includes a unitarily molded dielectric housing, generally designated 16, of plastic or like material. Housing 14 of connector 10 has a plurality of silos 18 for receiving male portions or terminals 20 of connector 12, the terminals being adapted for interengagement with appropriate terminals (not shown) within housing 14 of connector 10. Lastly, connector 10 includes a primary locking arm 22 mounted on housing 14 for mechanically interlocking with a cooperating latch 24 molded integrally with housing 16 of connecting device 12.

Still referring to FIG. 1, the connector position assurance system of the invention includes a locking slider, generally designated 26, that includes a pair of side flanges 28 slidably received in a pair of grooves 30 on opposite sides of a channel or recessed area 32 in the top of housing 14 of connector 10. It can be seen that the recessed area overlies primary locking arm 22. The slider may be assembled to the housing in the direction of arrow "A". When assembled, a top surface 34 of the locking slider is generally flush with a top surface 36 of the connector housing. Therefore, the slider is substantially completely shrouded by the housing to obviate any protuberances that may snag with extraneous electrical wiring or other components. Lastly, serrations 38 are formed on the top of slider 26 to facilitate manual gripping of the slider by a user's finger. The serrations are small enough that they cannot cause snagging with extraneous components, such as electrical wires.

Figure 2:
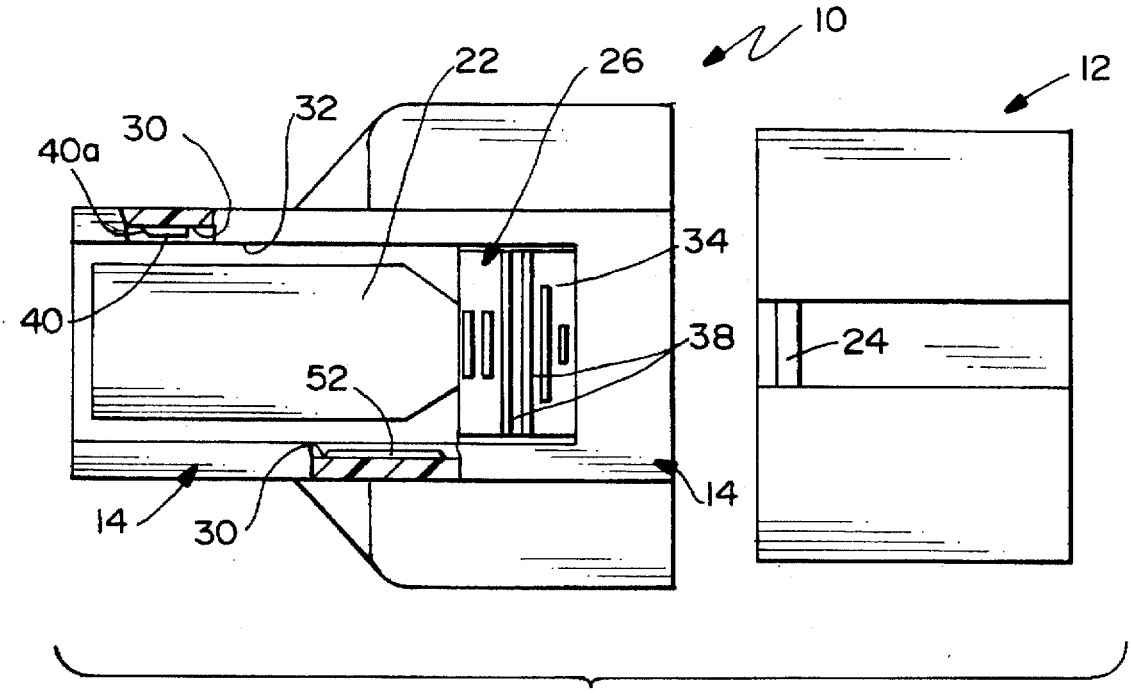
FIG. 2 is a top plan view, partially cut away, of the connector with the locking slider mounted thereon, again in conjunction with the mateable connecting device.

Referring to FIG. 2 in conjunction with FIG. 1, detent means are provided between connector housing 14 and locking slider 26 for maintaining the slider in a preloaded position within recessed area 32 of the housing. More particularly, a detent tab 40 projects inwardly from one groove 30 for engagement by the outside edges of side flanges 28 (FIG. 1) when locking slider 26 is assembled to the housing in the direction of arrow "A". It can be seen in FIG. 2 that the outer edges 40*a* of the detent tab 40 is chamfered to facilitate sliding the locking slider into the grooves past the detent tab 40. The adjacent walls of the housing will resiliently spread apart just slightly, and the locking slider will snap behind the detent tab 40 to maintain the slider mounted to the housing within grooves 30.

Figure 3:
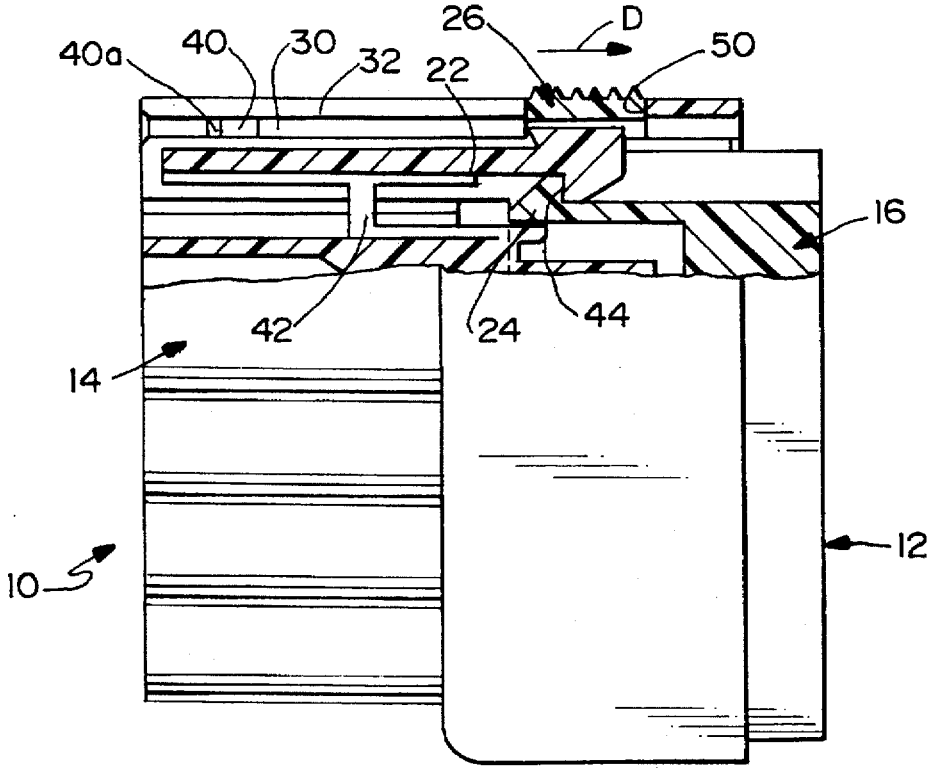
FIG. 3 is a side elevational view, partially cut away, of the connector and mateable connecting device in fully mated condition, with the locking slider in its operative position.
Figure 4:
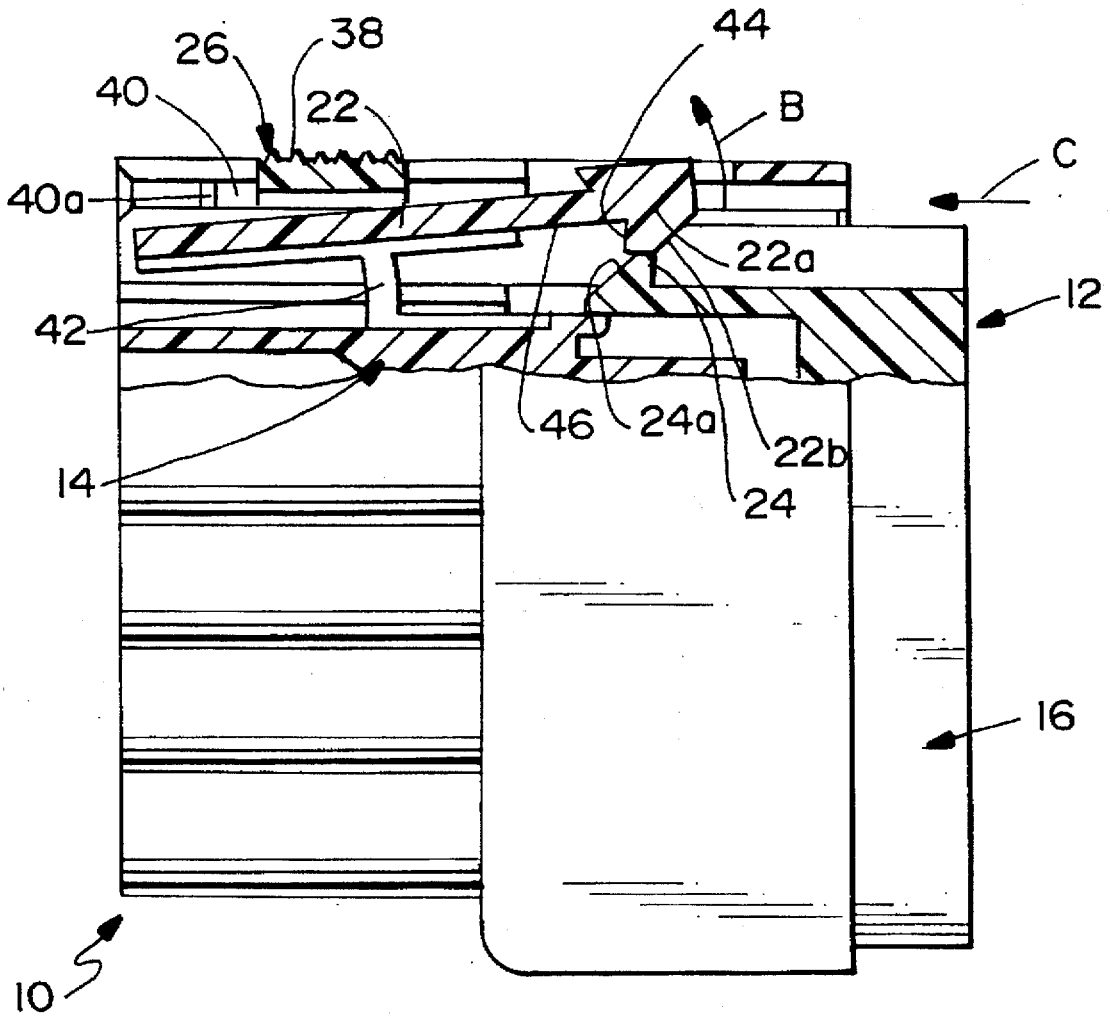
FIG. 4 is a view similar to that of FIG. 3, but with the connector and the mateable connecting device only partially or incompletely mated, with the locking slider in its inoperative position.

Referring to FIGS. 3 and 4 in conjunction with FIG. 2, locking slider 26 is slidable between a first position shown in FIG. 4 and a second position shown in FIGS. 2 and 3. In the first position of FIG. 4, the locking slider allows movement of locking arm 22 upwardly in the direction of arrow "B" and, thereby, allows mating of connector 10 with connecting device 12, as described hereinafter. In its second position shown in FIGS. 2 and 3, locking slider 26 blocks movement of locking arm 22 and, thereby, acts as a secondary locking mechanism to maintain the connector and the connecting device in mated condition, again as described in greater detail hereinafter.

FIGS. 3 and 4 show that locking arm 22 is pivoted to connector housing 14 by an integral living hinge 42. In other words, as stated above, the housing is unitarily molded of dielectric material, such as plastic or the like. Living hinge 42 is integrally molded between the locking arm and the housing. The locking arm has a distal end 22*a* that defines a latch shoulder 44 on the underside thereof for engaging cooperating latch 24 on connecting device 12. An abutment shoulder 46 is provided on the top of the locking arm.

In operation, locking slider 26 is placed in its first or preloaded position shown in FIG. 4. Connecting device 12 is mated with connector 10 in the direction of arrow "C" (FIG. 4) whereupon a leading chamfered surface 24*a* of cooperating latch 24 engages a chamfered leading edge 22*b* at the distal end of primary locking arm 22. This causes the locking arm to pivot about living hinge 42 in the direction of arrow "B". Of course, with locking slider 26 in its first position, as shown, the locking arm is allowed to pivot by engagement with cooperating latch 24.

When connector 10 is fully mated with mateable connecting device 12, as shown in FIG. 3, latching shoulder 44 of latch arm 22 automatically snaps downwardly behind cooperating latch 24 to provide a primary locking system to hold connecting device 12 in mated condition with connector 10.

Once the connector and the connecting device are fully mated as shown in FIG. 3 and described immediately above, locking slider 26 is moved in the direction of arrow "D" to its second position wherein the slider blocks movement of locking arm 22 away from engagement with cooperating latch 24. In its blocking position, the locking slider abuts against a front wall 50 of recessed area 32 of connector housing 14.

Detent means also are provided to hold locking slider 26 in its second position of blocking movement of locking arm 22. More particularly, referring back to FIG. 2, a detent tab 52 (similar to detent tab 40 but chamferred on both sides) projects inwardly from one groove 30 into the path of movement of side flanges 28 (FIG. 1) of the locking slider within grooves 30. The detent tab 52 allow the slider to be moved to its blocking position by a user, but the detent tab provides sufficient resistance to prevent the slider from inadvertently moving back away from its blocking position.

When the locking slider is in its blocking position, it prevents connector 10 and connecting device 12 from becoming unmated, because primary locking arm cannot move and disengage latching shoulder 44 from cooperating latch 24. The position of the locking slider also indicates that the connector and the connecting device are fully mated. The locking slider is mounted within recessed area 32 of connector housing 14 to substantially entirely shroud the slider. If the slider is in its first position as shown in FIG. 4, and locking arm 22 is biased upwardly to an incomplete mated condition, the slider cannot move to its second position because abutment shoulder 46 blocks the slider, and this clearly indicates that the connector and the connecting device are not fully mated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A connector position assurance system comprising:

a first connector having a housing having sidewalls with recesses therein;

a primary flexible locking arm on the housing, said primary locking arm including a projection for mechanically interlocking with a cooperating latch of a second connector; and a locking slider having flanges being mounted above said primary locking arm and in said recess so that said slider being slidable along a path between a first position allowing movement of said locking arm and mating of the first connector with the second connector and a second position blocking movement of the primary locking arm away from said first position; and wherein said primary locking arm in said second position blocks movement of the locking slider from said first position to said second position thereby indicating that the first connector and the second connector are not fully mated.

2. The connector position assurance system of claim 1 wherein said primary locking arm is pivotally mounted on the housing.

3. The connector position assurance system of claim 2 wherein said primary locking arm in a position for pivotal movement in an arc transverse to the path of sliding movement of said locking slider.

4. The connector position assurance system of claim 2 wherein said housing is of molded plastic material and the primary locking arm is pivoted to the housing by an integral living hinge means.

5. The connector position assurance system of claim 1 wherein each of said recesses comprises a channel in each of said sidewalls.

6. The connector position assurance system of claim 1 wherein said locking slider includes a serrated surface exposed exteriorly of the housing to facilitate manual gripping of the slider by a user's finger.

* * * * *